US008371342B2

(12) United States Patent
Weigel

(10) Patent No.: US 8,371,342 B2
(45) Date of Patent: Feb. 12, 2013

(54) FILLING DEVICE FOR THE VOLUMETRIC METERING OF POWDER

(75) Inventor: Marco Weigel, Backnang (DE)

(73) Assignee: Harro Höfliger Verpackungsmaschinen GmbH, Allmersbach (DE)

( * ) Notice: Subject to any disclaimer, the term of this patent is extended or adjusted under 35 U.S.C. 154(b) by 349 days.

(21) Appl. No.: 12/680,562

(22) PCT Filed: Sep. 27, 2007

(86) PCT No.: PCT/EP2007/008410
§ 371 (c)(1),
(2), (4) Date: Mar. 27, 2010

(87) PCT Pub. No.: WO2009/046728
PCT Pub. Date: Apr. 16, 2009

(65) Prior Publication Data
US 2010/0212777 A1 Aug. 26, 2010

(51) Int. Cl.
*B65B 1/20* (2006.01)

(52) U.S. Cl. ..... 141/80; 141/65; 141/242

(58) Field of Classification Search ..... 141/12, 141/65, 72, 73, 80, 237, 242, 285, 368
See application file for complete search history.

(56) References Cited

U.S. PATENT DOCUMENTS 3,211,190 A * 10/1965 Vogt ..... 141/5
5,187,921 A 2/1993 Wilson et al.

FOREIGN PATENT DOCUMENTS

EP 0474466 B1 11/1994
EP 0900645 A 3/1999

* cited by examiner

*Primary Examiner* — Gregory Huson
*Assistant Examiner* — Jason K Niesz
(74) *Attorney, Agent, or Firm* — Gudrun E. Huckett

(57) ABSTRACT

The invention relates to a filling device (1) for the volumetric metering of powder (2), particularly a powdery pharmaceutical. The filling device comprises a metering container (3, 4) having an inner chamber (5) and a peripheral edge (8, 9) around a filling opening (6, 7) of the metering container (3, 4), a planar retaining device (10), which is pervious to air, but impermeable to the powder (2), and covers the filling opening (6, 7) and the edge (8, 9) when filling the metering container (3, 4), a filling pipe (11), which is guided through the retaining device (10) and opens into the inner chamber (3) when filling the metering container (3, 4), and means for generating a pressure differential on the retaining device (10).

13 Claims, 4 Drawing Sheets

*Fig. 1*
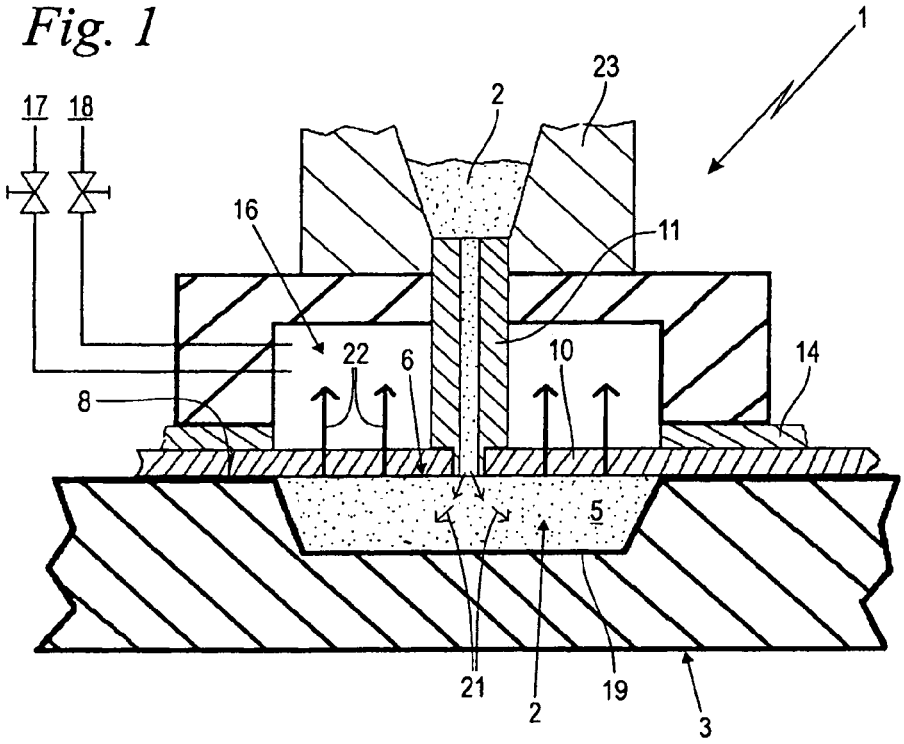
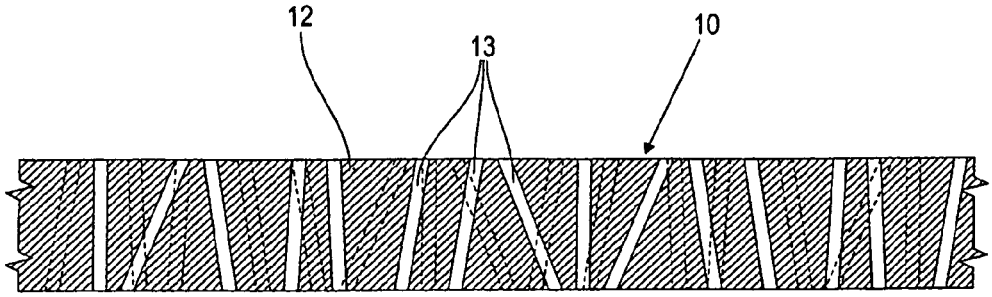
*Fig. 2*

FILLING DEVICE FOR THE VOLUMETRIC METERING OF POWDER

BACKGROUND OF THE INVENTION

The invention concerns a filling device for volumetric metering of powder, in particular for metering a powdery pharmaceutical.

Small powder quantities, in particular small quantities of a powdery pharmaceutical, for example, for pulmonary or transdermal administration, must be metered and packaged in individual doses of a few milligrams or even micrograms suitable for the user. Such metering by weighing is difficult so that frequently in such application situations a volumetric metering is done.

A known form of volumetric metering is realized by means of a so-called metering roller where a cylindrical roller is provided with one or several rows of calibrated metering chambers. The latter are filled with powder by using vacuum. Subsequently, the roller with the filled metering chambers is rotated into an upside down position in which the powder is blown out of the metering chambers into the provided individual containers. The metering precision that is achievable in this way is precise enough for most application situations. However, the processing speed is not always satisfactory. Moreover, it is required that the containers are aligned in a row with one another which alignment corresponds to the row of the metering chambers of the roller. Deviating container arrangements, for example, a circular arrangement, cannot be filled with the metering roller or filled only with difficultly.

EP 0 474 466 B1 discloses a device and a method for filling metering containers wherein the metering containers are formed directly by the storage containers in the form of blisters provided for use by the user. The blisters have a predefined individual volume and are immersed upside down into a powder thereby being completely filled with the quantity of its predetermined volume. Volumetric metering of the powder and filling of the blisters are done in a single working step. After completion of metering and filling, the blisters are sealed and are then ready to use.

The aforementioned form of filling enables potentially high processing speeds. However, for a reliable metering, a satisfactory filled powder bed must be made available permanently, wherein, after completion of the filling process, possibly significant residual quantities of usually rather expensive powder will remain. Filling in particular of smaller charges can therefore be uneconomical. Moreover, it has been observed that in general very finely dispersed powder that has the tendency to form agglomerates will adhere, as a result of the immersion process, on the sealing surfaces of the blisters so that a complex cleaning of the sealing surfaces before application of the sealing film is required. Stripping the sealing surfaces with a doctor blade not always leads to the desired cleaning effect and, moreover, a falsification of the metered amount as well as an undesirable compaction of the powder may result. A reliable seal-tight sealing action of the container is difficult.

The invention has the object to provide a filling device for volumetric metering of powder, in particular of a powdery pharmaceutical, with increased economic efficiency and processing safety.

SUMMARY OF THE INVENTION

In accordance with the present invention, this object is solved by a filling device for volumetric metering of powder, in particular of a powdery pharmaceutical, that has a metering container with an interior and with a rim that extends circumferentially about a fill opening of the metering container, a flat permeable retaining device that is however impermeable for the powder which retaining device upon filling of the metering container covers the fill opening and the rim, a filling conduit that passes through the retaining device and that, when filling the metering container, opens into the interior, as well as means for generating a pressure differential at the retaining device.

In the method according to the invention, the aforementioned arrangement enables an economic filling and volumetric metering of powder with high processing speed and high processing safety. By means of the pressure differential that exists at the retaining device with relatively increased pressure in the interior of the metering container and with reduced pressure at the opposite exterior side of the retaining device, the powder is introduced through the filling conduit into the interior of the metering container and retained therein by the retaining device. The pressure differential is maintained at least until the interior of the metering container has been completely filled with the powder. The volume that is defined or delimited by the shape of the metering container and by the retaining device determines precisely the volume of the powder quantity to be filled in. Since the retaining device not only covers the fill opening but also the rim of the metering container, no contamination of the rim with powder occurs. After removal of the retaining device no post-processing of the rim and the powder surface, for example, by stripping with a doctor blade, is required. The respective metering container can be filled to the rim with high processing speed and high metering precision and, if needed, can be sealed without any further intermediate steps.

In a preferred further embodiment the retaining device is embodied as a diaphragm with gas passages that pass through the diaphragm and are separate from one another. The separation of the gas passages from one another in the direction of the plane of the diaphragm enables flow through the diaphragm transversely to the diaphragm surface without flow occurring in the direction of the membrane surface. By means of the diaphragm that covers the rim area of the metering container, no foreign air can be sucked in at the rim areas in the lateral direction when a pressure differential is present; this contributes to increased metering precision and increased processing speed.

In an advantageous embodiment the retaining device is elastically deformable transversely to its surface wherein the filling conduit is connected fixedly to the retaining device. A filling level control of the powder in the interior of the metering container by lifting or lowering the filling conduit by utilizing the elastic yielding action of the retaining device is provided. The filling conduit that is embodied, for example, as an immersion tube can be inserted into or removed from the interior of the metering container, as needed, as the retaining device is resting against the container. Density fluctuations of different powder charges, volume fluctuations of the individual metering containers or the like can be compensated in a simple way. In any case, an adaptation of the filling volume to the respective need is possible in a simple way.

Alternatively, it can be expedient that the filling conduit is guided in the retaining device so as to be slidable in its longitudinal direction wherein a filling level control of the powder in the interior for the metering container is provided by sliding in or pulling out the filling conduit in the through passage of the retaining device. As in the case of the elastic deformation of the retaining device, an immersion of the filling conduit to a greater or lesser extent also leads to a filling level that is more or less distinct so that, as needed, an adaptation of the degree of filling or of the metered powder volume to the respective need is possible.

In a preferred embodiment, the retaining device covers continuously several metering containers. With a single diaphragm or film or the like, several containers can be filled at the same time; this increases the filling throughput and thus the economic efficiency of the arrangement significantly. In this connection, the relative orientation of the individual metering containers to one another is not important or only important to a limited extent. This enables a need-oriented, almost random relative arrangement of the metering containers, for example, in a matrix or circular shape wherein, however, other client-specific arrangements can be covered also without problem. All arrangements can be filled more or less at the same time which contributes to increased economic efficiency.

In a preferred embodiment, several filling conduits per metering container are passed through the retaining device. In this way, it is possible to fill to the rim also containers with irregular contour. Client-specific predetermined container shapes, for example, with corners or angles, can be filled with high processing safety without leaving any gaps by an adapted arrangement of the filling conduits.

Preferably, the retaining device is pressed circumferentially against the rim of the metering container by means of a pressing frame, particularly an elastic pressing frame that is contour-flush relative to the rim of the metering container. On the one hand, a reliable sealing action of the container interior is provided wherein the elastic configuration of the pressing frame compensates dimensional tolerances in the area of the container rim. On the other hand, it is ensured that the retaining device freely covers the fill opening completely up to the rim so that no dead space is produced. Even in the rim areas a gap-free powder filling is provided which also contributes to the precision of the volumetric metering. Alternatively, it can be expedient that the retaining device is pressed circumferentially against the rim of the metering container by means of a flat pressing plate that covers the rim and the fill opening and is air-permeable and in particular elastic. In addition to the aforementioned advantages in connection with the elastic pressing frame in this way it is also achieved that the arrangement is not tied to the format of the respective metering container. Without changes or adaptation of the pressing plate to the contour of the metering container to be filled, respectively, filling work with changing container shapes can be performed.

The aforementioned means for generating the pressure differential at the retaining device can be, for example, an overpressure source by means of which the powder is blown through the filling conduit into the interior of the metering container, respectively. In a preferred further embodiment, for the formation of the means for generating the pressure differential, at the side of the retaining device facing away from the metering container a chamber is arranged that is open toward the retaining device but otherwise is closed wherein the chamber has a connector to a vacuum source. For the actual filling process, the chamber is connected to the vacuum source so that vacuum is generated therein. In the powder reservoir there is atmospheric pressure so that, as a result, the desired pressure differential is generated at the retaining device. This causes the powder from the reservoir to be sucked in through the filling conduit into the container interior. Meanwhile, air flows through the retaining device without the powder particles being able to penetrate the retaining device. With simple means, a complete filling of the container interior is ensured.

In addition, it may be expedient that the retaining chamber is provided with a connection to an overpressure source. After completed filling, a short reverse flushing can be performed, as needed, with which powder adhering to or partially sucked into the retaining device is cleaned off.

In a preferred embodiment, the metering container is a container provided for a later sealing action. Without further intermediate measures, metering of the powder directly in the storage container takes place. The coverage of its rims with the retaining device keeps them free of powder so that without further cleaning measures a direct sealing action, for example, by gluing or welding a film thereon, can be done. Alternatively, it can be expedient that the metering container is a metering chamber that is provided for future filling of a storage container. This is primarily of interest when the metering volume is set to deviate significantly from the volume of the storage container. In any case, a great processing speed with high processing safety and excellent economic efficiency is provided.

In general, the presence of a powder bed is no longer needed. Instead, the powder is sucked in through the filling conduit from a storage container or a distribution conduit. The latter can be emptied completely during the run of the operation so that cost-intensive residual quantities must not be accepted.

BRIEF DESCRIPTION OF THE DRAWINGS

Embodiments will be explained in the following with the aid of the drawing in more detail. It is shown in:

FIG. 1 in a schematic longitudinal section illustration a filling device according to the invention with a metering container that is covered by a diaphragm, a filling conduit passing through the diaphragm, and a vacuum chamber arranged on the exterior side of the diaphragm;

FIG. 2 a schematic transverse section illustration of the diaphragm according to FIG. 1 with details of the gas passages extending through it;

DESCRIPTION OF PREFERRED EMBODIMENTS

Figure 3:
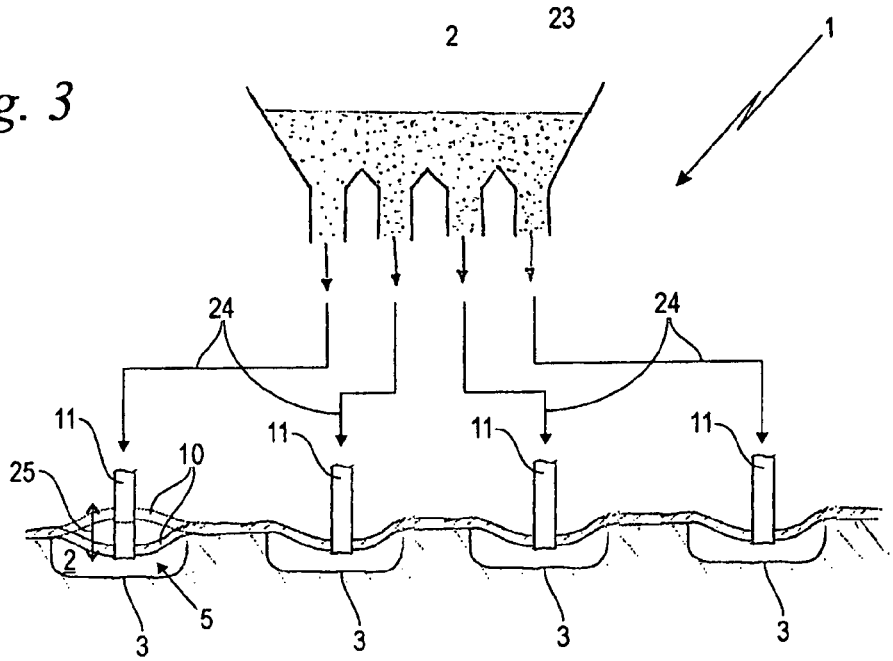
FIG. 3 a schematically illustrated variant of the arrangement according to FIG. 1 for simultaneous filling of several metering containers with filling conduits that are adjustable elastically with respect to immersion depth.

FIG. 1 shows in schematic longitudinal section illustration a filling device 1 according to the invention for volumetric metering of powder 2. The powder 2 in the illustrated embodiment is a powdery pharmaceutical whose grain size is in the range of approximately 5 micrometers or even smaller.

The filling device 1 comprises a funnel-shaped supply container 23 in which a supply of powder 2 is provided. Moreover, the filling device 1 comprises an air-permeable flat retaining device 10 that is however impermeable to the powder 2, as well as a filling conduit 11 that at its upper end opens into the supply container 23 and that in the area of its opposed lower end passes through the retaining device 10. Further parts of the filling device 1 include a pressing frame 14 as well as a chamber 16 that is open toward the retaining device 10 but otherwise is closed and has a connection to a vacuum source 17 and an overpressure source 18, respectively.

The illustrated arrangement is provided for simultaneously volumetrically metering a powder 2 and for filling a metering container 3. The metering container 3 in the illustrated embodiment is a storage container 19 provided for a later sealing process that, for this purpose, is typically embodied as a blister package. The metering container 3 has an interior 5 provided for receiving the powder 2, a fill opening 6 open to one side, as well as a rim 8 surrounding the fill opening 6.

The flat retaining device 10 can be a screen, a grid or the like and in the illustrated embodiment, in accordance with the schematic cross-sectional illustration of FIG. 2, is embodied as a diaphragm 12 with gas passages 12 that pass transversely through the diaphragm 12 and are separated from one another. The thickness of the diaphragm 12 in the illustrated embodiment is approximately 20 μm. However, deviating thicknesses may be expedient. The diameter of the individual gas passages, depending on the grain size of the powder 2 to be processed, is in a range of inclusive 0.4 μm to inclusive 1.0 μm. As needed, deviating sizes may be expedient.

The diaphragm 12 is comprised of an elastic plastic film that is elastic transverse to its plane of extension and into which gas passages 13 are etched. The gas passages 13 do not extend exactly at a right angle to the surface of the diaphragm 12 but have scattered angles relative thereto. However, no gas passages 13 are provided that extend within the plane of the diaphragm 12. Also, the individual gas passages 13 have no fluidic communication relative to one another. In this way, it is ensured that a gas exchange can take place only between the two faces of the diaphragm 12 but not in the direction of the plane or face of the diaphragm 12.

As a result of manufacturing technology it may happen that the individual gas passages 13 sporadically and to a minimal extent penetrate one another or contact one another so that in an exceptional situation individual gas passages 13 are communicating fluidically with one another. The separation of the individual gas passages 13 from one another in the context of the present invention means only that such fluidically conducting connections occur only sporadically or to a minimal degree but not to a significant extent so that a noticeable transverse flow within the plane or surface of the diaphragm 12 cannot be produced.

When filling the metering container 3 according to FIG. 1, the retaining device 10 covers the fill opening 6 as well as the circumferentially extending rim 8 of the metering container 3. The pressing frame 14 has an inner contour that at least approximately coincides exactly with the contour of the fill opening 6. The retaining device 10 is pressed circumferentially by means of the elastic pressing frame 14, contour-flush and seal-tightly, onto the rim 8 of the metering container 3. By means of the contour-flush arrangement of the pressing frame 14 relative to the fill opening 6 the retaining device 10 can be flowed through by air in the direction of arrows 22 across the entire surface area of the fill opening 6 without the powder 2 being able to penetrate through the retaining device 10. As a result of the seal-tight contact caused by the elastic pressing frame 14 and the lack of possibility for transverse flow within the plane of the retaining device 10, external influences from outside of the metering container 3 and the chamber 16 are precluded.

During the filling process according to FIG. 1 the filling conduit 11 passing through the retaining device 10 opens in the interior 5 of the metering container 3. In this connection, the chamber 16 rests seal-tightly on the retaining device 10 on the side of the retaining device 10 facing away from the metering container with interposition of the pressing frame 14. The chamber 16 is only open toward the retaining device 10. In other respects, with the exception of the connections to the vacuum source 17 and the overpressure source 18, it is closed so that the interior of the chamber 16 can be loaded, as needed, with vacuum or overpressure. In this way, means are formed for generating a pressure differential between the two sides of the flat retaining device 10.

In usual operation in the area of the supply container 23 atmospheric pressure exists while during the course of the filling process the chamber 16 is connected to the vacuum source 17. As a result of the generated pressure differential an air flow is created that in accordance with arrows 22 flows from the interior 5 of the metering container 3 through the retaining device 10 into the interior of the chamber 16. This air flow is sucked in from the supply container 23 through the filling conduit 11 wherein the powder 2 from the supply container 23 is entrained through the filling conduit 11 in accordance with arrows 21 into the interior 5 of the metering container 3. The aforementioned diameter of the gas passages 13 (FIG. 2) has the effect that the sucked-in air in accordance with arrows 22 can be sucked through the retaining device 10 but the particles of the powder 2 are retained at the retaining device 10. Since the retaining device 10 is flowed through across the entire surface of the fill opening 6, the powder 2 is distributed in the entire interior 5 of the metering container 3 until a gap-free filling of the interior 5 up to the rim is achieved.

In practical operation it cannot be excluded that individual passages 13 (FIG. 2) will become clogged with powder grains. After completed filling of the interior 5 the connection to the vacuum source 17 can be interrupted and instead the connection to the overpressure source 18 can be produced. In this way, the pressure differential is reversed. A brief flow through the retaining device 10 opposite to the arrows 22 takes place which leads to cleaning of the gas passages 13.

After completion of the aforementioned process, the interior of the chamber 16 is loaded with atmospheric pressure so that the metering device 3 can be removed from the retaining device 10. Since the latter during the filling process has been resting seal-tightly on the rim 8 of the metering container 3, the rim 8 is completely free of contamination by the powder 2. Only in the interior 5 the powder 2 is present which has been metered precisely by means the volume of the interior. Immediately after removal of the metering container 3 from the retaining device 10 the circumferential rim 8 can be sealed with a sealing film by gluing or welding. A sealed storage container 19 is formed which, without further intermediate steps, is completed for storage and utilization by the consumer.

Depending on the size of the metering container 3 and the fine-pore configuration of the retaining device 10, almost any individual quantities of powder 2 in almost any grain size can be filled in and metered. In particular, the filling device 1 and the corresponding method are suitable to meter and fill in very small powder quantities in particular in the medical field. For example, in pulmonary applications the individual quantities may be in a range of inclusive 0.3 mg to 50 mg. Typically, they are within a range of inclusive 2 mg to inclusive 25 mg. In case of a powdery pharmaceutical for transdermal applications, the individual quantities are typically in a range of inclusive 0.2 mg to inclusive 5 mg. The volume of the interior 5 of the individual metering container 3 is within a range of inclusive 0.1 μl to inclusive 100 μl.

FIG. 3 shows in a schematic view a further embodiment of the filling device 1 according to FIG. 1 in which the retaining device 10 has a large surface area and covers continuously several metering containers 3. For each metering container 3 a filling conduit 11 is provided, respectively, that at a suitable location passes through the retaining device 10 and opens in the interior 5 of the individual metering container 3, respectively. All filling conduits 11, as indicated by arrows 24, are supplied from a common supply container 23 with the powder 2.

The retaining device 10 is embodied so as to be elastically deformable transverse to its surface wherein a first deformation end position is indicated with solid lines and a second deformation end position is illustrated with dashed lines. The individual filling conduits 11 each are fixedly connected to the retaining device. By utilization of the elastic yielding action of the retaining device 10, the individual filling conduits 11 together with the section of the retaining device 10 connected thereto can be lifted or lowered in accordance with double arrow 25. Depending on the height adjustment of the respective filling conduit 11, it projects together with the section of the retaining device 10 connected thereto more or less far into the interior 5 of the respective metering container 3. In this way, a volume adaptation of the interior 5 is provided. Since a complete filling of the interior 5 with the powder 2 is provided, also a filling level control of the powder 2 in the interior 5 is realized in this way. Metering of the powder quantity to be filled into the respective metering container 3 can be corrected or adjusted in this way.

Figure 4:
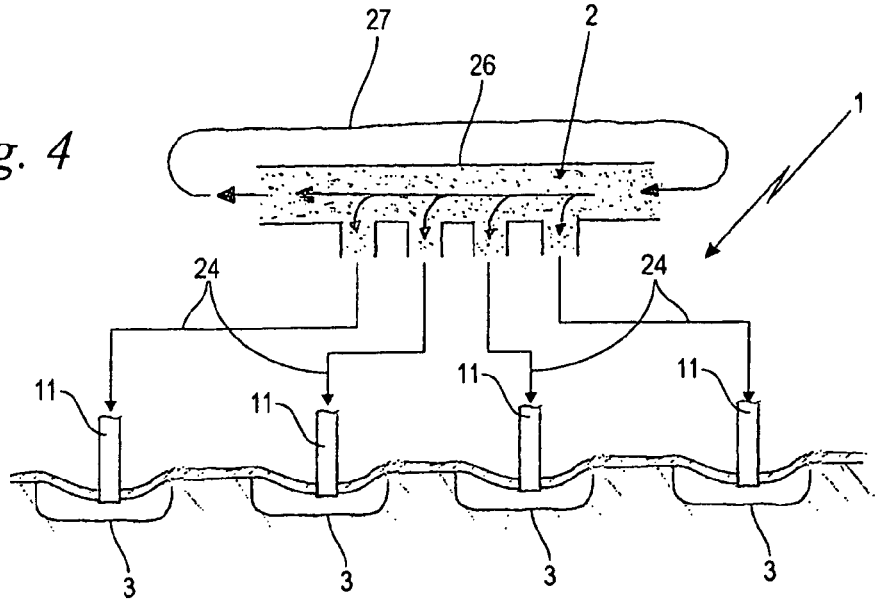
FIG. 4 a variant of the arrangement according to FIG. 3 with a continuously supplied distribution conduit for the different filling conduits.
Figure 5:
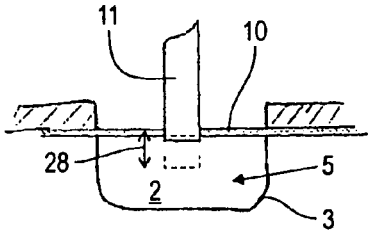
FIG. 5 a schematic illustration of an embodiment with a filling conduit that passes slidably through the retaining device for effecting the filling level.

FIG. 4 shows another variant of the arrangement according to FIG. 3 in which the individual filling conduits 11 are supplied from a common distribution line 26 with the powder 2. Instead of a supply from a supply container 23 in accordance with FIG. 3, according to FIG. 4 it is provided that the powder 2 in accordance with arrow 27 is continuously conveyed in circulation through the distribution line 26 so that continuous uniform supply conditions are present in the distribution line 26 and thus also in the individual filling conduits 11. In regard to other features and reference numerals the arrangement according to FIGS. 3 and 4 coincide with one another as well as with the arrangement according to FIGS. 1 and 2.

Further embodiments of the invention are illustrated in FIGS. 5 through 12. Here it also applies that the features and reference numerals coincide with one another and with the afore described embodiments, if not noted otherwise. As an alternative to the embodiment of FIGS. 3 and 4, in the embodiment according to FIG. 5 it is provided that the filling conduit 11 is guided through the retaining device 10 so as to be slidable in its longitudinal direction, as its illustrated by double arrow 28 as well as by the end positions of the filling conduits 11 indicated by dashed lines. In analogy to the illustration according to FIG. 3, a filling level control of the powder 2 in the interior 5 of the metering container 3 is realized in that the filling conduit 11 is pushed through the retaining device 10 more or less deeply into the interior 5 or removed therefrom. The retaining device 10 itself remains in place without carrying out any noticeable deformation.

Figure 6:
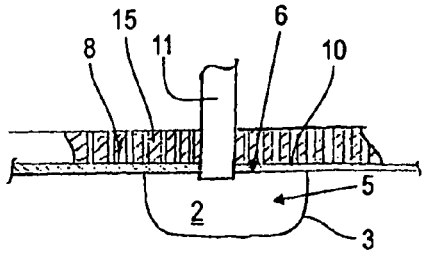
FIG. 6 an embodiment with a pressing plate that covers completely the metering container and is air-permeable.

In the embodiment according to FIG. 6, instead of the elastic pressing frame 14 an in particular elastic pressing plate 15 is provided that is penetrated by gas passages distributed across its surface area and therefore is permeable. The flat pressing plate 15 covers one or several metering containers 3 including the correlated fill openings 6 and rims 8. In this connection, the respective retaining device 10 is pressed circumferentially against each rim 8 of the metering container 3 so that a sealing action of the interior 5 is provided. The gas passages that extend through the pressing plate 15 are comparable to the gas passages 13 according to FIG. 4 so that here also no significant transverse flow within the plane of the pressing plate 15 can be generated. Nonetheless, the air-permeable pressing plate 15 enables the generation of a pressure differential and flow through the retaining device 10, as explained in connection with FIG. 1. The flat configuration of the pressing plate 15 is independent of any format, i.e., is not tied to the contour of the individual metering containers 3. Without adaptation of the retaining device 10 and the pressing plate 15, different types of metering containers 3 with any contour of its fill opening 6 can be filled.

Figure 7:
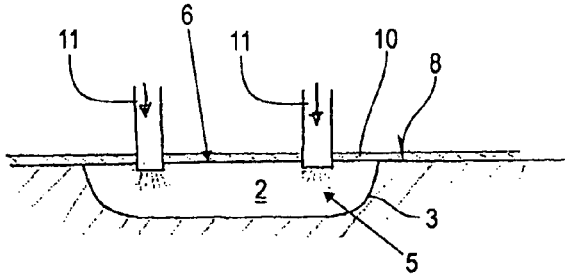
FIG. 7 an embodiment with several filling conduits per metering container.

FIG. 7 shows a schematic illustration of a further embodiment of the invention in which each individual metering container 3 has correlated therewith at least two or even more individual filling conduits 11. The individual filling conduits 11 pass in the afore described way through the retaining device 10 and open at different locations of the individual metering container 3 in its interior 5. This enables the gap-free filling of the interior 5 flush with the rim even for irregular contours of the fill openings 6, in particular when individual filling conduits 11 are arranged in the corner areas of the respective metering container 3.

Figure 8:
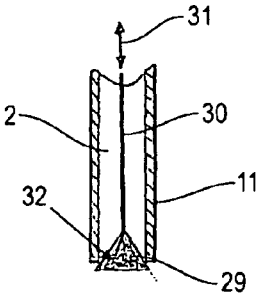
FIG. 8 in a schematic detail view a filling conduit with a valve element.

FIG. 8 shows a detail view of a possible embodiment of the filling conduit 11 according to a preceding embodiment in the area of its end facing the container. The filling conduit 11 has at its end face that is facing the container a supply opening 32 for the powder 2 that, as needed, can be closed by a schematically illustrated valve element 29. In the illustrated embodiment, for this purpose a pull rod 30 is provided that is connected to the valve element 29 and by means of which the valve element, in accordance with double arrow 31, can be pulled seal-tightly into the supply opening 32. Sealing of the supply opening 32 by means of the valve element 29 can be done as needed, for example, when in accordance with the illustration of FIG. 1, the retaining device 10 is blown out with overpressure in the chamber 16. In this case, the valve element 29 prevents that the powder 2 is blown through the filling conduit 11 in reverse direction. Instead of actuation by the pull rod 30 it may also be expedient to provide an automatic actuation of the valve element 29.

Figure 9:
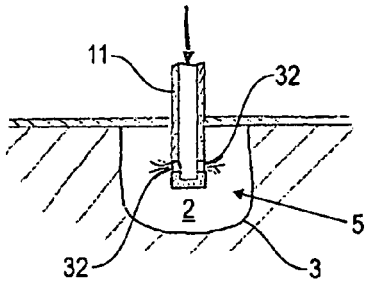
FIG. 9 a variant of the filling conduit with lateral supply openings.

Alternatively or in addition to the embodiments according to FIGS. 1 through 8, also an embodiment of the fill opening 11 in accordance with the illustration of FIG. 9 may be expedient in which one or several supply openings 32 are distributed on the circumference of the end of the filling conduit 11 projecting into the interior 5 of the metering container 3. For certain shapes of the metering container 3, this can contribute to improved filling of the interior 5 with the powder 2.

Figure 10:
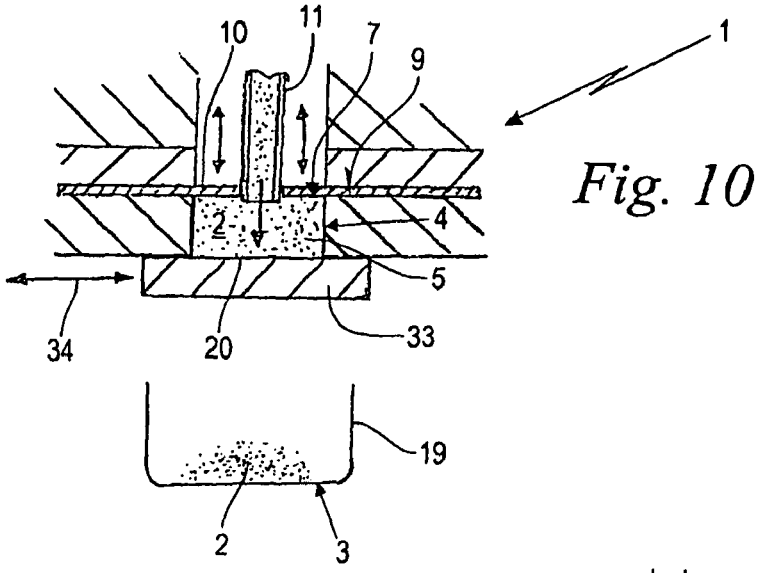
FIG. 10 an embodiment of the invention with a metering container embodied as a metering chamber for filling a separate storage container.
Figure 11:
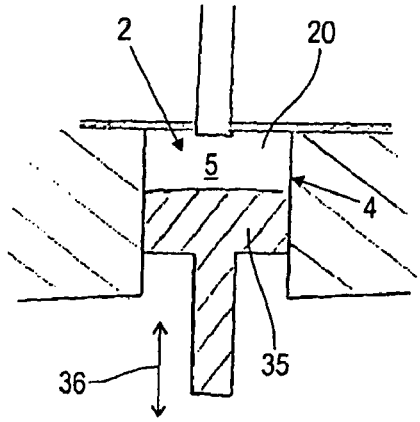
FIG. 11 a detail variant of the embodiment according to FIG. 10 with a metering chamber that is adjustable with respect to its volume by means of a piston.
Figure 12:
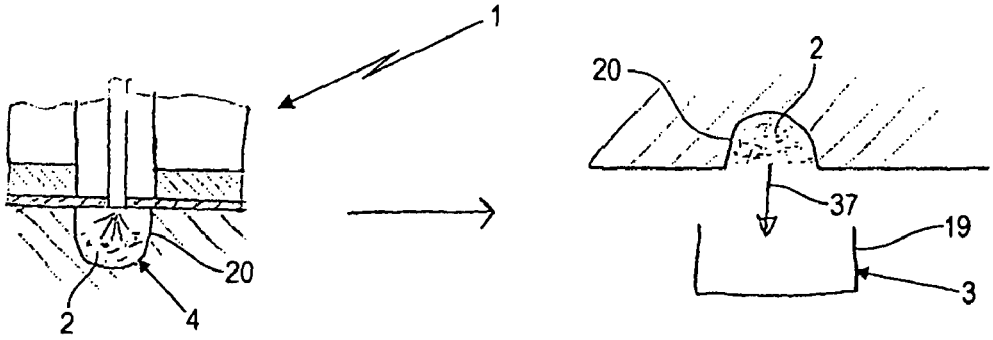
FIG. 12 a further variant of the arrangement according to FIG. 10 with a metering chamber that is pivotable into an upside down position for filling the storage container.

The FIGS. 10 through 12 show in schematic illustration a further variant of the filling device 1 and of the correlated method wherein the metering container 3 formed as a storage container 19 is not directly filled but filled by means of an additional metering container 4 that is embodied as a metering chamber 20. In analogy to the metering container 3 according to FIGS. 1 through 9, the metering container 4 has a fill opening 7 and a circumferentially extending rim 9 wherein the fill opening 7 and the circumferentially extending rim 9 are covered, as described above, by the flat retaining device 10. In deviation from the metering container 3, the metering container 4 embodied as a metering chamber 20 has at its bottom side an opening that is closed by a closure plate 33. With otherwise identical features and reference numerals, the metering container 4 is filled as described above wherein the powder 2 is metered volumetrically in accordance with the volume of its interior 5. After completed metering action, the closure plate 33, in accordance with double arrow 34, can be pushed to the side so that the volumetrically metered powder 2 can drop out of the metering chamber 20 into the metering container 3 arranged underneath that is embodied as a storage container 19.

Alternatively or in addition to the closure plate 33 of FIG. 10, a piston 35 can be provided in accordance with the illustration of FIG. 11 that, in accordance with double arrow 36, can be pushed more or less far into the interior 5 of the metering container 4. In this way, a volume adaptation of the interior 5 can be provided so that the volume of the powder 2 to be metered can be adjusted in the metering chamber 20.

A further embodiment is illustrated in FIG. 12. The metering container 4 embodied as a metering chamber 20 corresponds together with the remainder of the filling device 1 substantially to the embodiment of FIGS. 1 to 9 and is filled analogously with the powder 2. After completed filling, the metering chamber 20 is turned upside-down so that the powder 2 contained therein in accordance with arrow 37 drops into the metering container 3 underneath that is embodied as a storage container 19.

What is claimed is:

1. A filling device for volumetric metering of powder, the filling device comprising:

a metering container with an interior and with a fill opening communicating with said interior and surrounded circumferentially by a rim;

an air-permeable flat retaining device that is impermeable for the powder, wherein said retaining device covers during filling of said metering container said fill opening and said rim;

a filling conduit passing through said retaining device and opening into said interior when filling the powder into said metering container;

pressure generating means that generate a pressure differential at said retaining device;

wherein said pressure generating means comprises a chamber arranged on a side of said retaining device that is facing away from said metering container, wherein said chamber is open toward said retaining device but otherwise is closed, wherein said chamber has a connector to a vacuum source.

2. The filling device according to claim 1, wherein said retaining device is a diaphragm with gas passages that extend transversely to a face of said retaining device through said diaphragm and that are separated from one another.

3. A filling device for volumetric metering of powder, the filling device comprising:

a metering container with an interior and with a fill opening communicating with said interior and surrounded circumferentially by a rim;

an air-permeable flat retaining device that is impermeable for the powder, wherein said retaining device covers during filling of said metering container said fill opening and said rim;

a filling conduit passing through said retaining device and opening into said interior when filling the powder into said metering container;

pressure generating means that generate a pressure differential at said retaining device;

wherein said retaining device is elastically deformable transverse to a face thereof so as to provide an elastic yielding action, wherein said filling conduit is fixedly connected to said retaining device, and wherein a filling level control for the powder in said interior of said metering container is provided by lifting or lowering said filling conduit by utilizing said elastic yielding action of said retaining device.

4. A filling device for volumetric metering of powder, the filling device comprising:

a metering container with an interior and with a fill opening communicating with said interior and surrounded circumferentially by a rim;

an air-permeable flat retaining device that is impermeable for the powder, wherein said retaining device covers during filling of said metering container said fill opening and said rim;

a filling conduit passing through said retaining device and opening into said interior when filling the powder into said metering container;

pressure generating means that generate a pressure differential at said retaining device;

wherein said filling conduit is guided through said retaining device so as to be slidable in a longitudinal direction of said filling conduit, wherein a filling level control for the powder in said interior of said metering container is provided by sliding in or pulling out said filling conduit relative to said metering container.

5. The filling device according to claim 1, wherein said retaining device covers continuously several of said metering container.

6. The filling device according to claim 1, wherein several of said filling conduit are provided for each one of said metering container.

7. The filling device according to claim 1, further comprising a pressing frame, wherein said retaining device is pressed circumferentially against said rim by said pressing frame that is embodied to be contour-flush with said rim.

8. The filling device according to claim 7, wherein said pressing frame is elastic.

9. A filling device for volumetric metering of powder, the filling device comprising:

a metering container with an interior and with a fill opening communicating with said interior and surrounded circumferentially by a rim;

an air-permeable flat retaining device that is impermeable for the powder, wherein said retaining device covers during filling of said metering container said fill opening and said rim;

a filling conduit passing through said retaining device and opening into said interior when filling the powder into said metering container;

pressure generating means that generate a pressure differential at said retaining device;

a flat, air-permeable pressing plate, wherein said retaining device is pressed circumferentially against said rim by said pressing plate that covers said rim and said fill opening.

10. The filling device according to claim 9, wherein said pressing plate is elastic.

11. The filling device according to claim 1, wherein said chamber has a connector to an overpressure source.

12. The filling device according to claim 1, wherein said metering container is a storage container to be sealed later.

13. The filling device according to claim 1, wherein said metering container is a metering chamber configured to fill a storage container.

* * * * *